US005893627A

United States Patent [19]

Tague

[11] Patent Number: 5,893,627

[45] Date of Patent: Apr. 13, 1999

[54] AUTOMATIC LOW VOLTAGE LIGHTING SYSTEM FOR CABINETS AND CLOSETS

[75] Inventor: James W. Tague, 2005 Brownfield Rd., Rockford, Ill. 61108

[73] Assignee: James W. Tague, Rockford, Ill.

[21] Appl. No.: 08/602,280

[22] Filed: Feb. 16, 1996

[51] Int. Cl.[6] ..... F21V 33/00

[52] U.S. Cl. ..... 362/133; 362/155; 362/296; 362/418; 362/432

[58] Field of Search ..... 362/127, 133, 362/145, 154–156, 432, 94, 269, 274, 285, 296, 418, 419; 200/61.62, 61.73, 61.76, 61.78

[56] References Cited

U.S. PATENT DOCUMENTS

| | | | |
|---|---|---|---|
| 1,532,935 | 4/1925 | Patton | 362/133 |
| 2,411,100 | 11/1946 | MacDonald | 362/155 |
| 3,312,968 | 4/1967 | Kiefer, Jr. | 200/61.62 |
| 4,203,639 | 5/1980 | VandenHoek et al. | 362/127 |
| 4,277,781 | 7/1981 | Hunyadi | 200/61.62 |
| 4,554,618 | 11/1985 | Bafunno et al. | 200/61.62 |
| 5,032,957 | 7/1991 | Canfield | 362/133 |
| 5,205,638 | 4/1993 | Squitieri | 362/133 |
| 5,246,285 | 9/1993 | Redburn et al. | 362/155 |
| 5,580,155 | 12/1996 | Hildebrand et al. | 362/133 |

*Primary Examiner*—Alan Cariaso

[57] ABSTRACT

A lighting system including lamps mounted to best illuminate the interior of the cabinet enclosure. The lighting system shall incorporate normally closed switches mounted in proximity to the cabinet door. The lamps are illuminated when the cabinet door is opened, closing the electrical circuit and the lamps are extinguished when the cabinet door is closed, opening the electrical circuit. The lamps and switches are connected to a step-down transformer by means of electrical wire using crimp connectors. The step-down transformer converts standard house hold electrical voltage 120 VAC, to a voltage below 14 VAC. The step-down transformer power source may be replaced by a battery power source.

11 Claims, 16 Drawing Sheets

91

92

93

AUTOMATIC LOW VOLTAGE LIGHTING SYSTEM FOR CABINETS AND CLOSETS

BACKGROUND OF INVENTION

1. Field of Invention

This invention relates generally to automatic lighting systems and more particularly to a lighting system readily installed in cabinets and closets. The light or lights are illuminated when the door is opened and extinguished when the door is closed.

Storage cabinets in the home frequently contain various cleaning solvents, cooking oils, insecticides, pesticides, and beverages in close proximity to each other. Serious personal injuries and even deaths of persons have been recorded as the result of picking an unintended item from a storage area.

Standard storage cabinets, found in homes, offices, and factories are not supplied with lighting devices of any type.

The main reason being that a safe, practical, effective cabinet lighting devices have not been previously developed, or offered to the storage cabinet industry, nor to the the general public for aftermarket installation.

Automatic lighting by opening the door, of home appliances such as refrigerators and ovens, has been used for many years. Home appliance lighting utilizes line voltage 120 Volt Alternating Current, at 60 Hz.

Automobile interiors are also lighted automatically upon opening of the doors. Automotive electrical circuits normally utilize 12 Volt, Direct Current.

Line voltage lighting, induces several undesirable characteristics to cabinets, high bulb temperatures, that can be a fire ignition point. The danger of serious electrical shock, when applied to metal cabinets, and the difficulty of installation by persons of nominal mechanical skills, to meet electrical codes.

Most house holds in the U.S. are powered by 120 VAC, 60 Hz. circuits, to utilize 12 VDC in household applications requires a conversion unit of some type, such as a rectifer, inducing unnecessary added cost and the risk of electrical shock, to the purposed lighting system. A low voltage power supply, consisting of a step-down transformer reduces the risk of dangerous electrical shock. The power supply can be internally or externally fused to provide maximum safety to users and electrical components.

A battery pack, consisting of Wet or Dry cells may be substituted for the step-down transformer. Some battery powered cabinet lights have been utilized for cabinet lighting in the past.

2. Description of the Prior Art

J. S. Patton, was granted a U.S. Pat. No. 1,532,935 for a device for Electrically Illuminating Card Cabinets.

From the description given in the the patent, the device has several features that would make the device both a fire and electrical hazzard. i.e. A paper reflector to direct the light beam or pattern. Line voltage to exposed metal to metal contact switch. The system as described is not an easy aftermarket installation.

VandenHoek et al., U.S. Pat. No. 4,203,639 describes a method of distributing electrical power in a hard wired, bolt on system for movable room dividers. This system is an important safety and cost improvement over flush floor mounted, line voltage recepticals. The system as described, could best be installed by a qualified electrician.

Squitieri, U.S. Pat. No. 5,205,638 describes a system for illuminating merchandise in shelves by Back lighting, utilizing small florescent tubes. This is an improvement over incandescent lamps and their inherent problems of electrical consumption, heat and related fire hazzards. This system as described, uses line voltage by means of a plug to a wall out let or extension cord and pertains to display shelves. The system as described is for as built shelf system, not applicable to aftermarket installations, without major alterations to the existing shelves.

A cabinet lighting unit that is currently marketed under U.S. Pat. No. 5,032,957 Canfield; incorporates the switch, power supply, lamp, and reflector in one unit.

This limits the lighting units mounting capabilities to places where a shelf, cabinet wall or ceiling is in close proximity to the door. The light pattern or beam is limited by the mounting position. This system is not readily adaptable to powering more lamps than the one enclosed in its body.

A second cabinet lighting system, U.S. Pat. No. 5,580,155 Hildebrand et al., describes a lighting unit that incorporates the switch, lamp and reflector in one unit. The power supply being located at a remote location. The switch/lighting unit as described, attached to an interior cabinet wall in proximity to the cabinet door. The light pattern or beam is also limited by the mounting position of the switch/lighting unit. This invention does not describe controlling more than one switch/lighting unit in either cabinets or closets.

Kitchen and bathroom cabinets are typically of a standard design for width, depth and height. The under sink cabinets sold for kitchens are based on a standard sink size. A high percentage of these cabinets, 97% are of a double door design.

Only the sides of the cabinets provide walls on which to mount either of the afore mentioned switch/lighting systems. None of the afore mentioned cabinets offers a ceiling, the space being filled with either drawers or plumbing devices. Blind kitchen corner cabinets are generally the largest found in a typical home. Some measure as large as 48" wide, and 24" deep, containing 1\3 or 1\2 depth shelves running the full width. Corner cabinets generally offer a drawer in the upper portion, below the counter top. The typical blind corner cabinet offers only one wall to accommodate a switch/lamp assembly.

Modern kitchen lighting systems offer excellent counter top and general lighting, but with less than 25% of a floor mounted cabinet space being adaquately illuminated to readily identify objects within the cabinet. Personal experience indicates that when searching for items stored in the cabinets, a shadow is cast into the cabinet, further reducing the available light within the cabinet.

The previously mentioned switch/lamp assemblies do not completely solve the the existing double door bathroom or kitchen sink lighting problems without adding a mounting system. Nor do they provide for additional lamps that might be required for sufficient lighting in large or multi shelved cabinets or closets.

More switch/lamp assemblies could be added if a mounting surface is available, which could induce unnecessary cost and reduce available storage space. No provision is provided for the adjustment of the light pattern or beam to optimize the use of the available light. The lighting systems do not address how they might be adapted to other types of doors in common use, such as pocket or center hinged doors used where space is at a premium.

The previously mentioned lighting systems solve some problems of lighting the interior of cabinets and closets. There is an obvious need for a flexible, cost and space efficient, nonintrusive lighting system, that can solve many other enclosure lighting problems.

SUMMARY OF THE INVENTION

The present invention is an automatic lighting system to illuminate entire cabinet or closet cavities when the door is opened. Conversely the lighting system is extingished when the door is closed.

The invention consists of a number of lamp assemblies that are mounted in optional positions on the frame work, facings or the bottom of the counter top to maximize the illuminating effect. The lamp assembly support bracket, can be bent or twisted to further optimize the light beam or pattern within the cavity.

The lamp assemblies being controled by a normally closed switch mounted on or in the door frame. Lamp and switch assemblies to be connected by means of 2 conductor electrical wire, 18 to 22 Ga. and crimp type, female connectors. The wires require a hole size of 1\8 " or less, to be threaded through the cabinet floor or shelves.

The cabinet electrical supply being provided by a step-down transformer, via 2 conductor electrical wire. The step-down transformer being a plug in wall outlet type. Transforming 120 VAC electrical power to 13 VAC. A battery pack consisting of wet or dry cells may be substituted for the step-down transformer.

The lighting system is efficient, cost effective, safe to install for a person with little or no previous electrical experience. Because the system utilizes low voltage power and very efficient low wattage lamps, fire and burn hazzards to users are minimized. The polished metal clam shell type reflector not only directs the light beam, but absorbs some of the heat generated by the light bulb. All proposed standard electrical components furnished with the system, have been tested and approved, to meet or exceed the established standards of Underwriter Laboratories.

The invention has many uses and applications other than lighting kitchen and bathroom cabinets. Enclosures such as bedroom, coat and linen closets are a few examples. The lighting of clinical, hospital medicine and tool storage cabinets are among the many applications of this very useful lighting system.

Other features, advantages and applications of the invention shall become readily apparent from the following more detailed description, when taken in conjunction with the accompanying drawings. The drawings illustrate by way of example the principles and some applications of the invention.

BRIEF DESCRIPTION OF DRAWINGS

FIG. 13 2 Conductor, 22 AWG, Copper Wire 141, Plastic Insulated, Color Coded Red 142, White 143, FIG. 14 Two conductor, 22 AWG, Copper Wire 141, Plastic Insulated, Color Coded, Red 142, White 143

DETAILED DESCRIPTION OF THE PREFERRED EMBODIMENT

Figure 1:
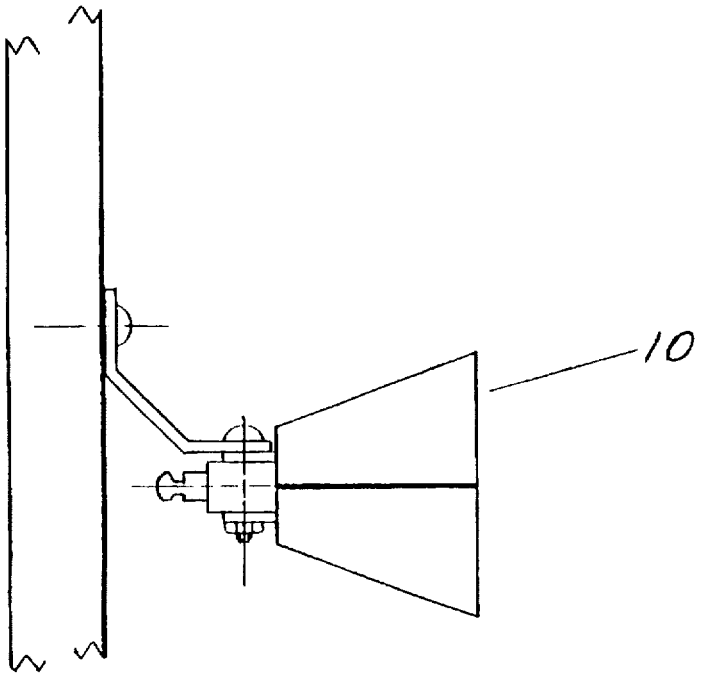
FIG. 1 Lamp Assembly Mounted
Figure 1A:
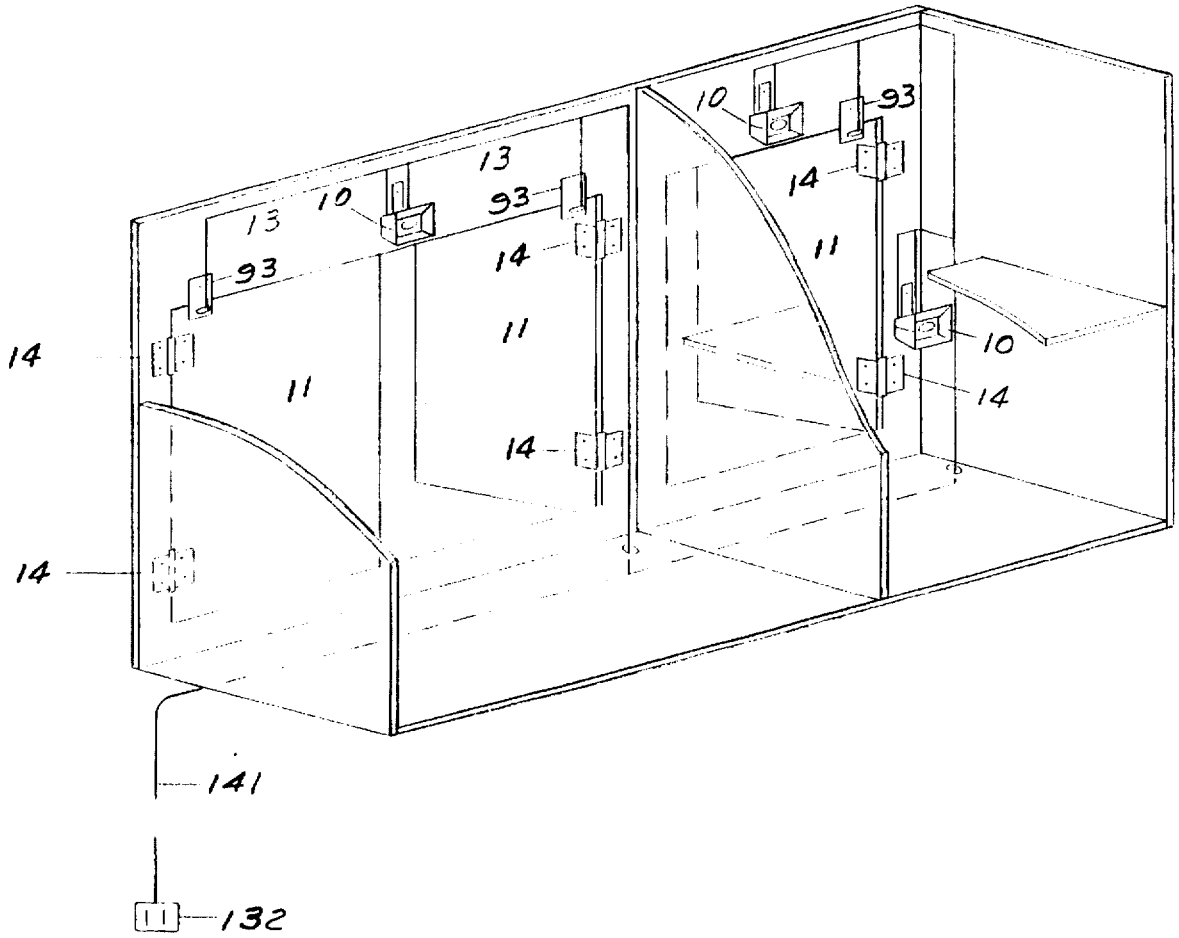
FIG. 1*a* is a perspective view of the present invention showing two switches in a parallel circuit operating one lamp assembly and one switch operating two lamp assemblies in a parallel circuit and additionally showing wires to an external power source.
Figure 2:
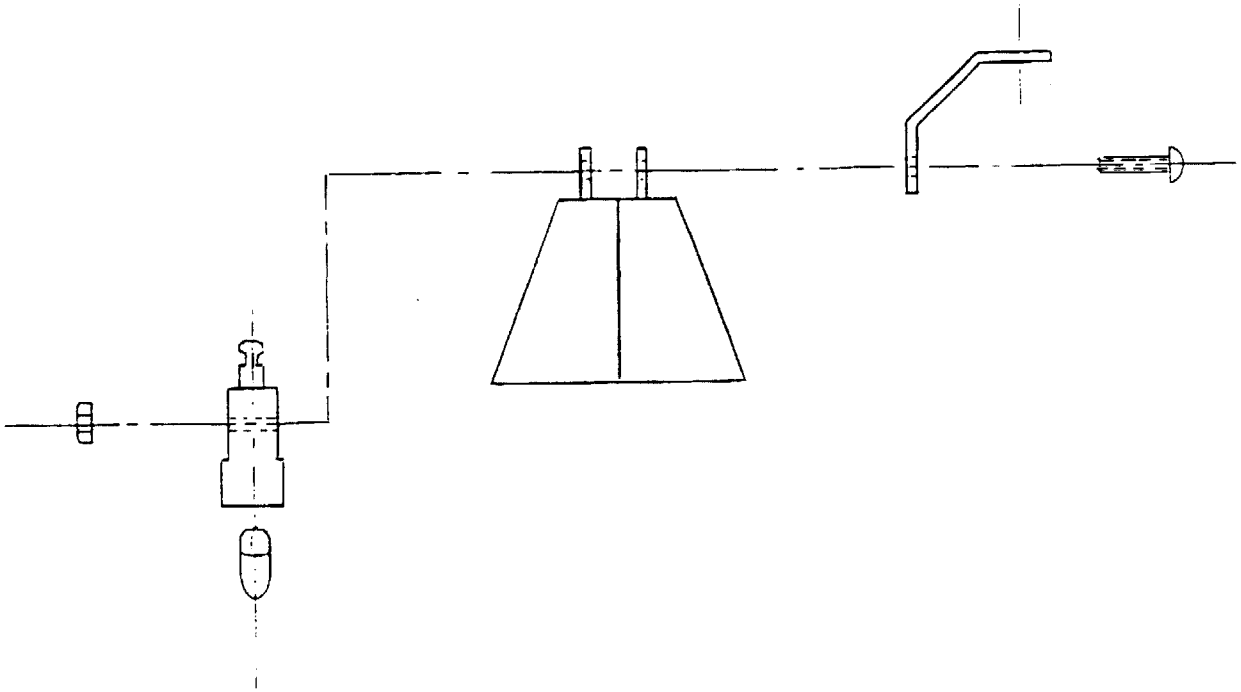
FIG. 2 Lamp Assembly Components
Figure 3:
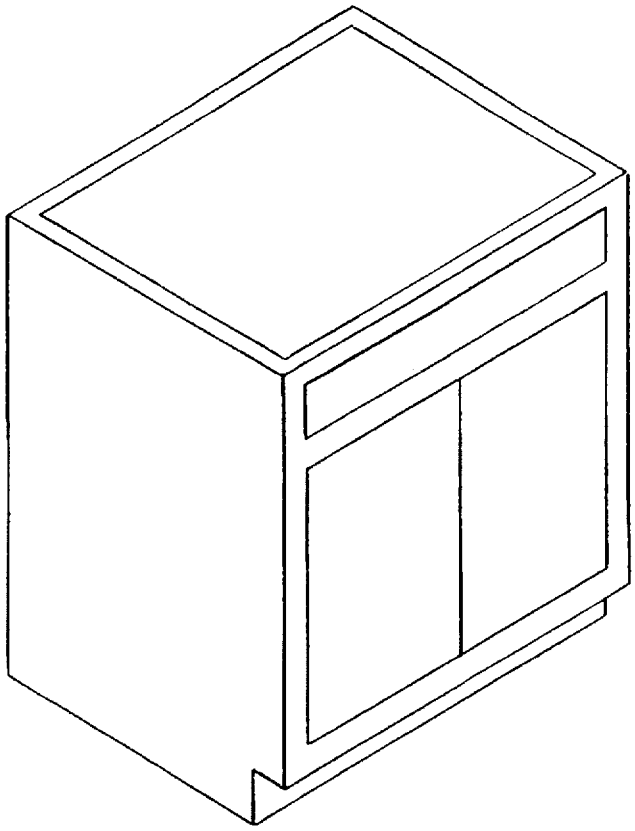
FIG. 3 Sink/Cabinet Base with Double Door Facing
Figure 4:
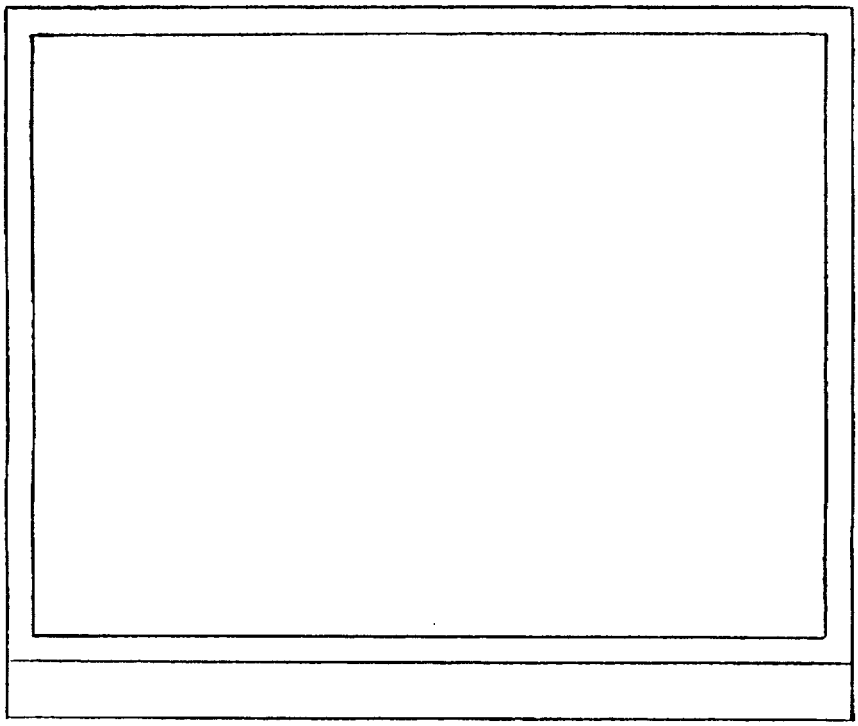
FIG. 4 Base Double Door, Front Opening
Figure 5:
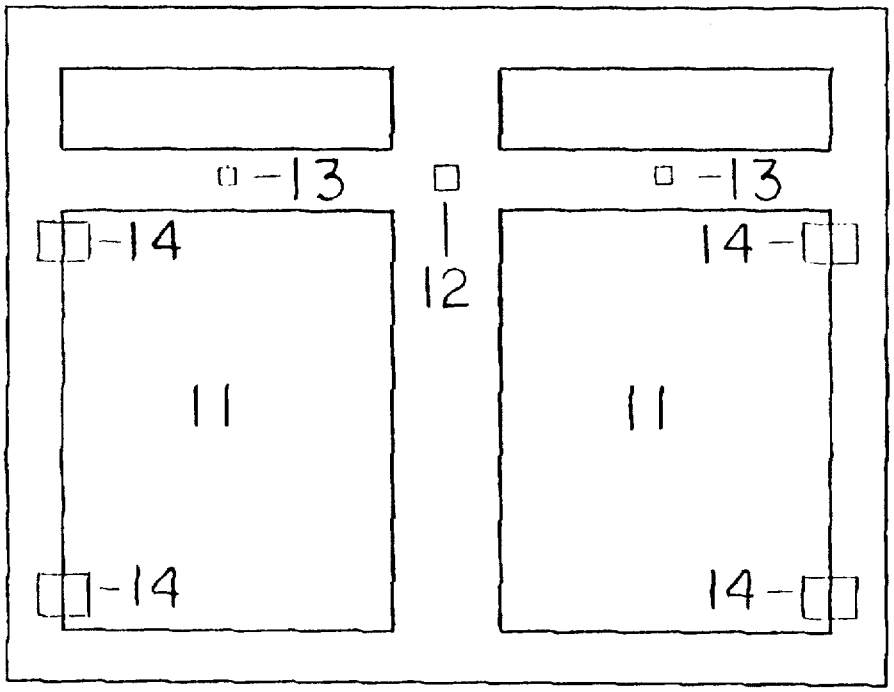
FIG. 5 Sink/Cabinet Facing, Double Door, Interior
Figure 6:
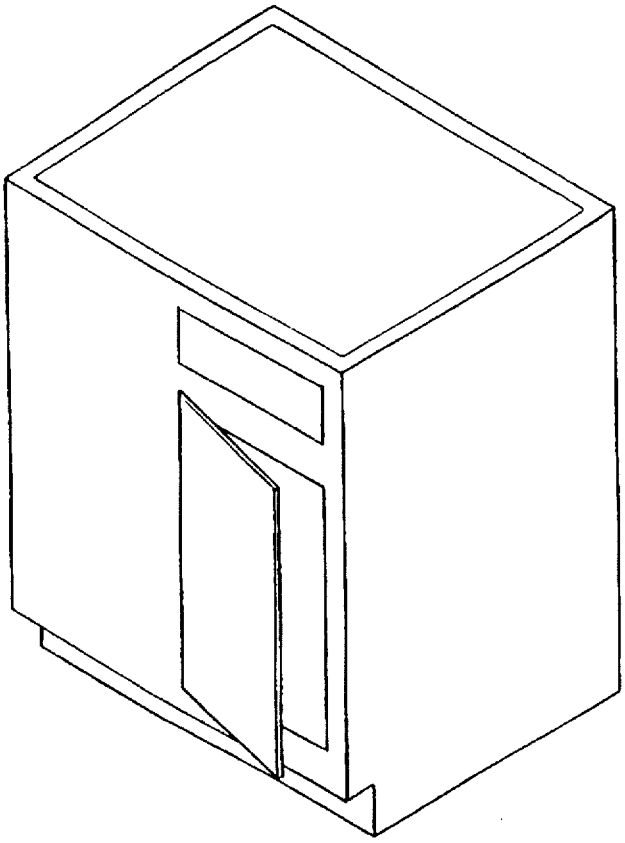
FIG. 6 Base Blind Corner With Partial Facing

Referring now to the drawings, FIG. 1 Shows a lamp assembly 10 composed of the components found in FIG. 2, designed to illuminate a typical sink base double door cabinet, FIGS. 1*a* and 5. The doors 11 being mounted to the back side of a sink facing FIGS. 1*a* and 5, a lamp assembly FIG. 1 mounted at the point marked 12; optional and multiple mountings for extra wide double door sink bases are marked 13, cabinet facing doors, hinged on the outer perimeter of the door openings at points 14.

Figure 7:
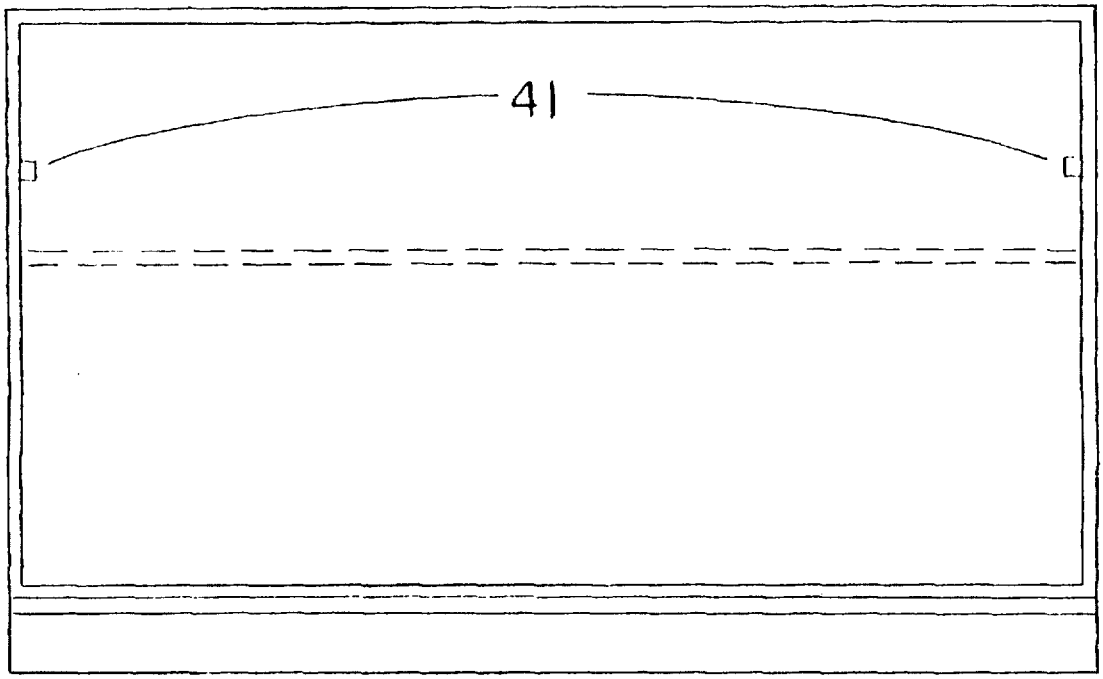
FIG. 7 Base Blind Corner Both Sides Open
Figure 8:
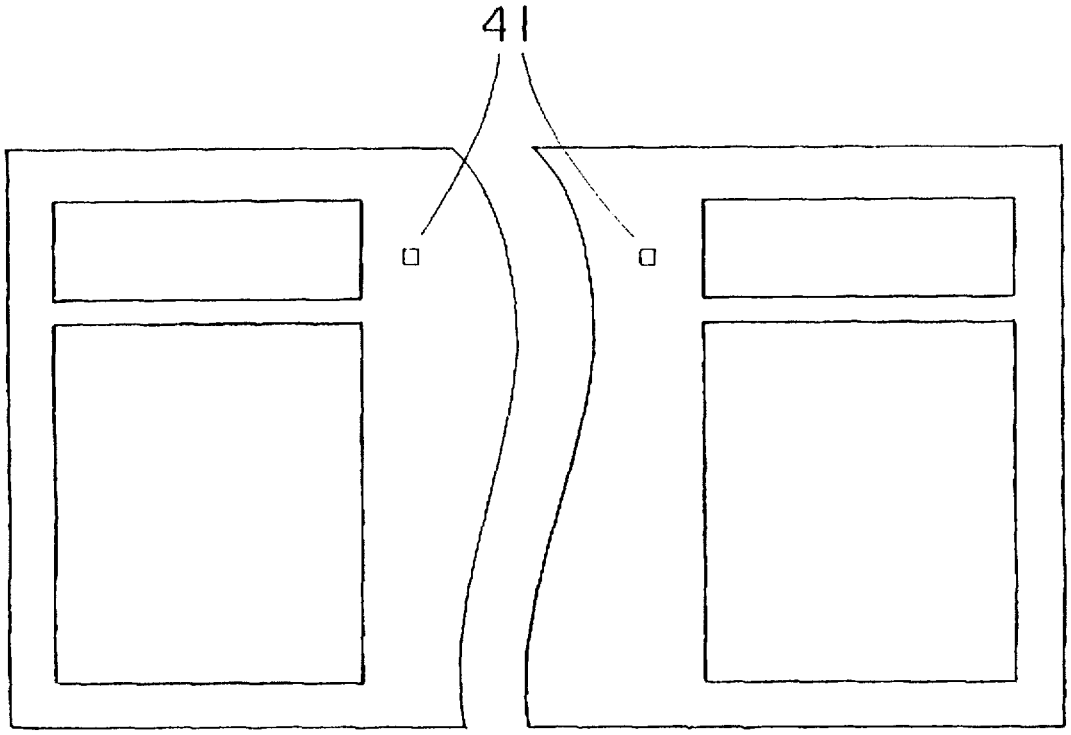
FIG. 8 Blind Corner Facing Interior View
Figure 10:
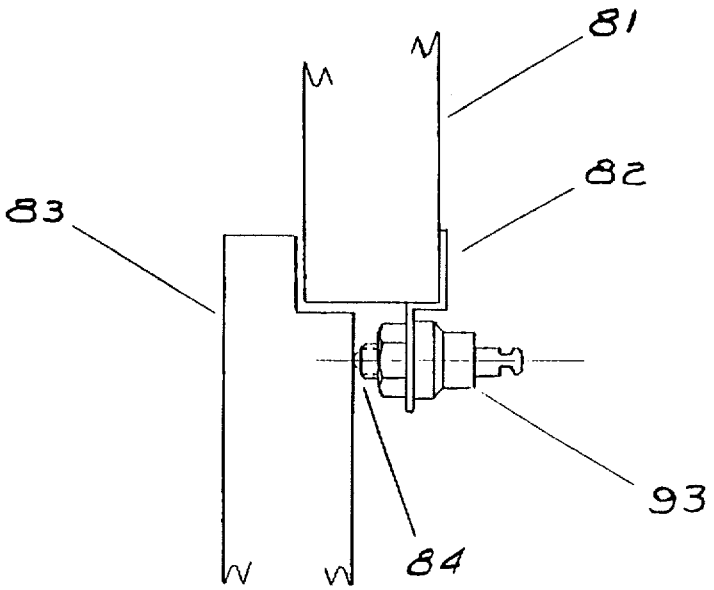
FIG. 10 Switch & Bracket Assembly on Facing At Door Opening
Figure 10:
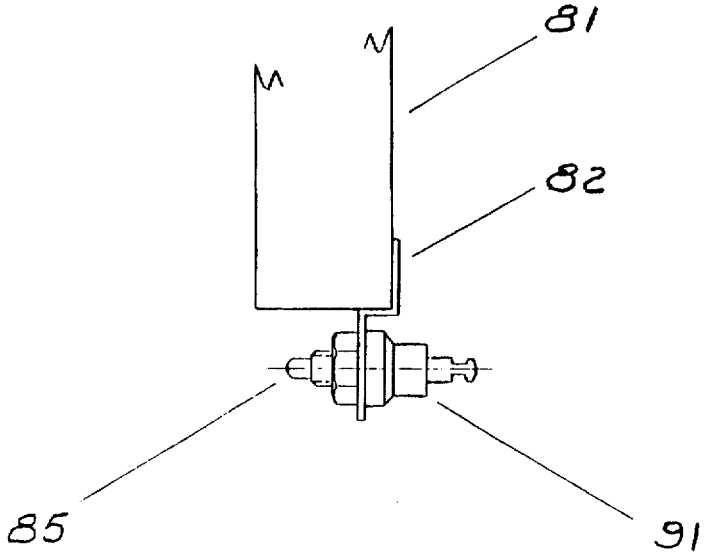

FIG. 7 & 8 Show how a multiple of lamp assemblies FIGS. 1, 10 could be mounted in a large blind corner base cabinet at points marked 41.

Figure 9:
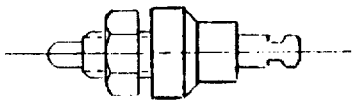
FIG. 9 Swith, Bracket and Assembly
Figure 9:
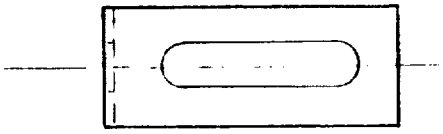
Figure 9:
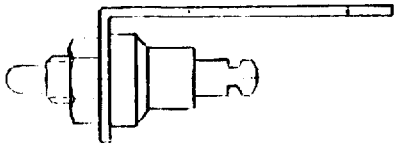

FIG. 9 shows the switch bracket 92 and switch 91, FIG. 9 also shows the switch bracket assembly 93. FIG. 10 shows the switch bracket assembly 93 mounted on the interior of a cabinet/sink facing {drawn schematically} 81, secured by a screw 82. FIG. 10 also shows a schematically drawn door in the the closed position 83, this compresses the spring loaded switch plunger 84 of the normally closed switch 91, creating an open electrical circuit. FIG. 10 also shows the absence or open door situation, with the spring loaded plunger of the normally closed switch in its normal/extended position 85, creating a closed electrical circuit.

Figure 11:
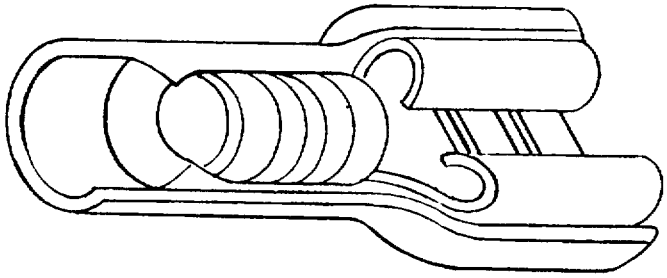
FIG. 11 Fully Insulated Female Quick Disconnect

FIG. 11, shows a fully insulated female quick disconnect that will accommodate one or two strands of 22 Ga. wire and will securely hold them, after being crimped.

Figure 12:
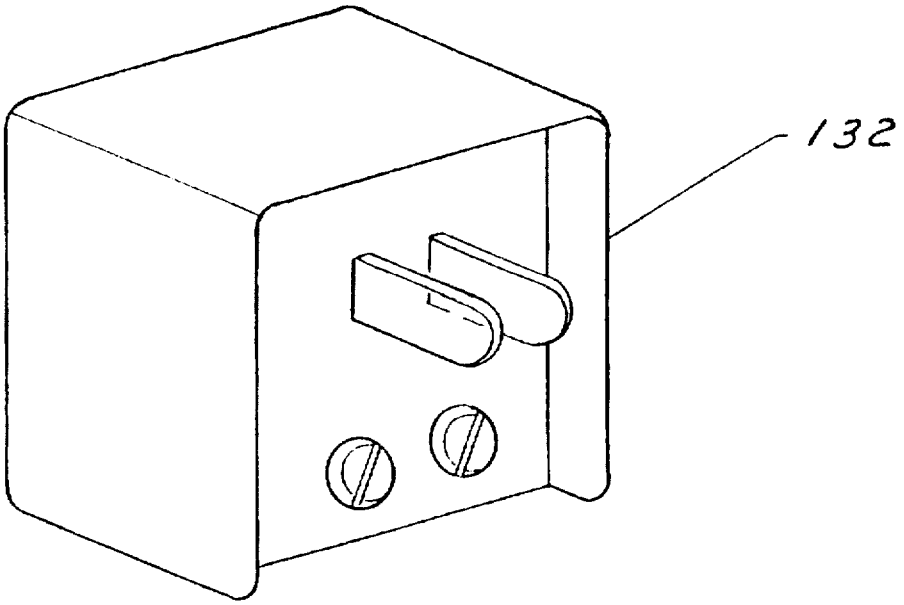
FIG. 12 External Power Supply A.C.—A.C. [step-down transformer]

FIG. 12 shows a type of step-down transformer, also known in the trade as External power supply AC—AC, to reduce line voltage 120 VAC to a lower voltage of 13 VAC and internally fused at 1.3 Amps.

Figure 13:
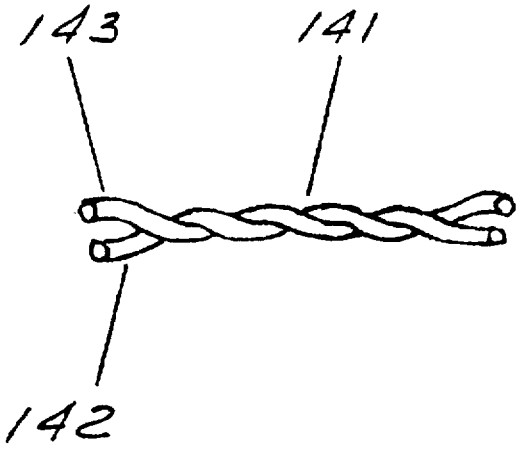

FIG. 13 Shows 2 conductor, 22 Ga. copper wire, plastic insulated 141, color coded red 142 and white 143, length up to 500 feet.

Figure 14:
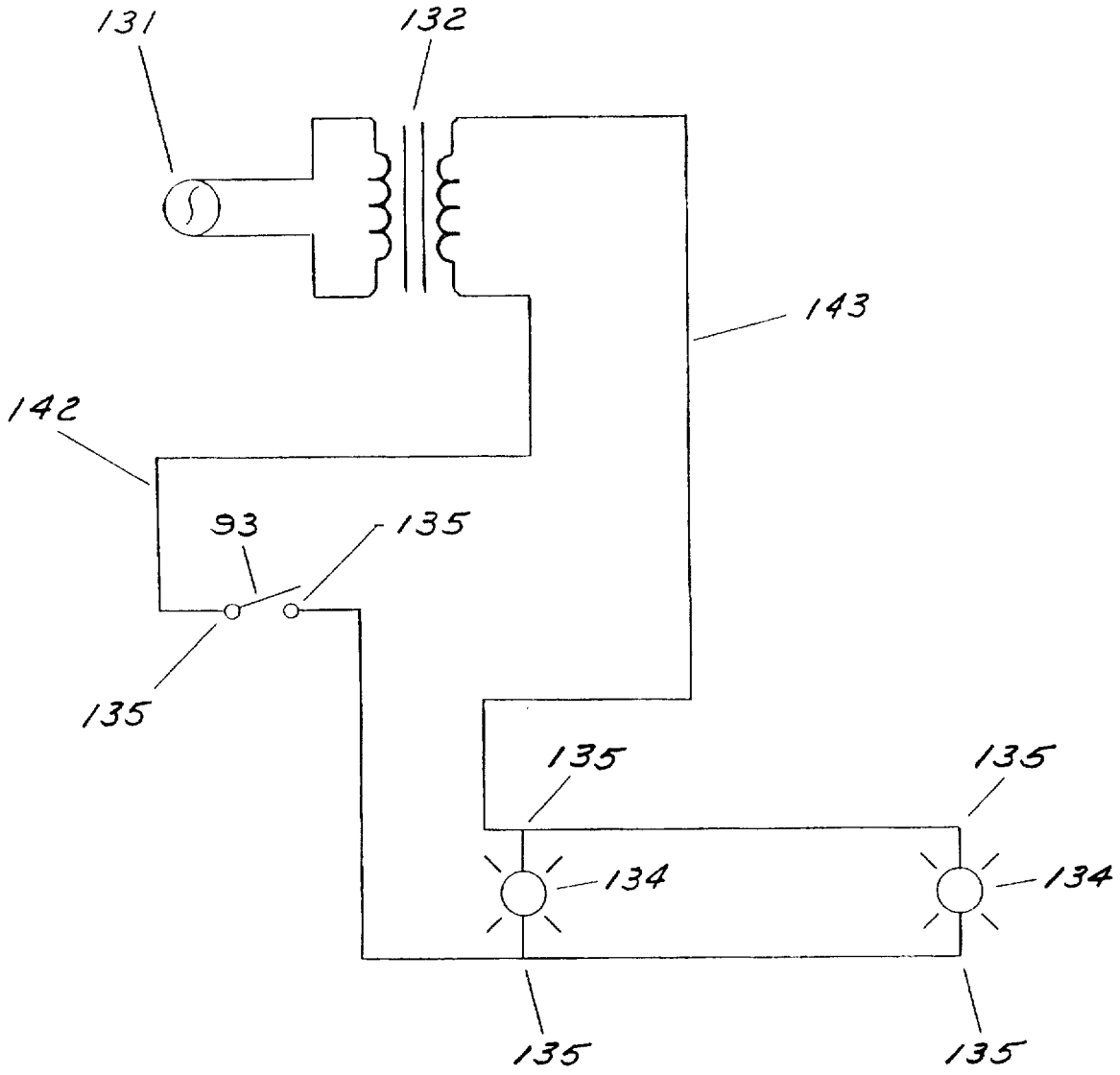
FIG. 14 Electrical Schematic, Lamps In Parallel

FIG. 14 Shows a schematic drawing of a power source, wall outlet 131, step-down transformer FIG. 12, 132, a normally closed switch 91, and two lamp assemblies FIG. 1, item 10, 134 wired in parallel, as applied to a large blind corner cabinet, FIGS. 1*a* 7 & 8 item 41.

Again referring to FIG. 14, the step-down transformer 132, normally closed switch 91, FIG. 9, lamps 134, FIG. 1, are connected by wire as described in FIG. 13. Female disconnects FIG. 11, are used to connect the wire to the switch 91 and lamps 134 at points marked 135. This circuit, FIG. 14, using the step-down transformer can power up to 10 lamps 134.

Figure 15:
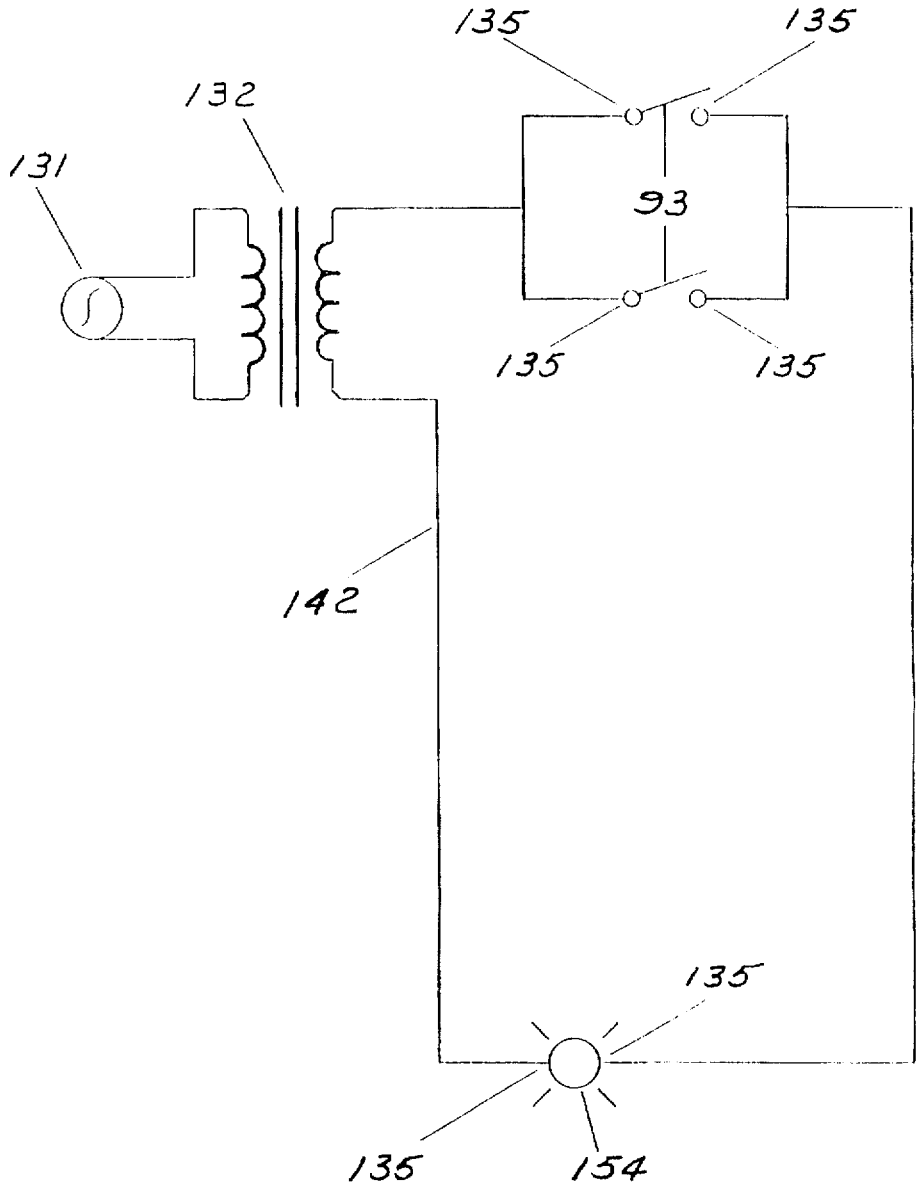
FIG. 15 Electrical Schematic, Switches In Parallel.

FIG. 15 shows a schematic drawing of a power source, wall outlet 131, step-down transformer FIG. 13, 132, a pair of normally closed switches FIG. 9, 91, wired in parallel and a lamp assembly FIG. 1, item 10, marked 154. Again referring to FIG. 15, the step-down transformer 132 FIG. 13, normally closed switch 91 FIG. 9, are connected by wire as described in FIG. 13. Female disconnects FIG. 11 are used to connect the wire to the switch 153 and lamp 154 at points marked 135. Again referring to FIG. 15, this circuit as described and as applied to a double cabinet, can be operated with any number of switches.

This lighting system is designed to work in conjunction with Pocket, Center Hinged and Accordian type doors. The lamp assembly mounting bracket, could be designed in other configurations or materials, high friction ball joints, to aid in lamp adjustment is one variation. The spring loaded, plunger activated, normally closed switch could be placed in other positions or other forms of normally closed switches could operate the proposed system. While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not limited by the specific illustrative embodiment, but only by the appended claims.

I claim:

1. A lighting system for providing illumination within a cabinet with an inside and a door connected for opening and closing, the system comprising:

a low voltage power source;

a bracket connected to the inside of the cabinet;

a lamp connected to the bracket, the lamp including
a holder,
a light source connected to the holder,
a reflector with first and second ends, the first end connected to the holder, the second end being substantially open,
the holder and reflector acting together to substantially surround the light source;

a switch including
a housing, and
a plunger located in the housing;

the plunger being movable between a closed position and an open position to establish electrical continuity in the switch in the closed position and to establish electrical discontinuity in the open position;

the switch being connected to the inside of the cabinet remote from the bracket and positioned so that the plunger contacts the door when the door is closed, the switch being open when the door is closed, the switch closing when the door is opened; and electrical wires connecting
the switch and the power source, and
the switch and the light source;

so that the light is energized for illuminating the inside of the cabinet when the door is open and the switch closed, and so that the light is de-energized when the door is closed and the switch is open.

2. The system of claim 1 wherein the reflector is substantially non-translucent so that light shines only through the second end of the reflector.

3. The apparatus of claim 1 wherein the reflector includes two clam-shell halves having first ends connected to the holder and the second ends that cooperate to define the second substantially open end of the reflector so that the clam-shell halves act together to substantially surround the light source.

4. The apparatus of claim 3 wherein the reflector is generally rectangular in cross-section.

5. The apparatus of claim 1 wherein the power source is a step-down transformer.

6. The apparatus of claim 1 wherein the power source is a battery.

7. The apparatus of claim 1 wherein the bracket is elongated with the first end connected to the cabinet, a second end connected to the lamp, and a center that is made from a malleable material so that the lamp can be positioned as desired in the cabinet.

8. The apparatus of claim 1 wherein the electrical wires include crimp-type connectors for easy connection of additional lamps and switches.

9. The apparatus of claim 1 further comprising a second lamp electrically connected to the switch in a parallel circuit for energizing and de-energizing simultaneously with the first lamp.

10. The apparatus of claim 1 further comprising a second switch electrically connected to the power source and the lamp, the switches being connected in a parallel circuit so that each switch independently controls the operation of the light source.

11. A lighting system for providing illumination within a cabinet with an inside and a door connected for opening and closing, the system comprising:

a low voltage power source;

a first bracket connected to the inside of the cabinet remote from the power source;

a second bracket connected to the inside of the cabinet remote from the first bracket;

a lamp connected to the first bracket, the lamp including
a holder,
a light source connected to the holder,
a substantially non-translucent reflector;

the reflector comprising two clam shell halves having opposing first and second ends, the first end connects to the holder, the holder and reflector acting together to substantially surround the light source, the second ends being substantially open so that the light shines only through the second ends;

the first bracket having a center section made from a malleable material and located between the cabinet and the lamp so that the lamp can be positioned to shine in the cabinet in a desired direction;

a switch including
a housing, and
a plunger located in the housing;

the plunger being movable between a closed position and an open position to establish electrical continuity in the switch in the closed position and to establish electrical discontinuity in the open position;

the switch being connected to the second bracket and positioned so that the plunger contacts the door when the door is closed, the switch being open when the door is closed, the switch closing when the door is opened; and electrical wires connecting
the switch and the power source, and
the switch and the light source;

so that the light is energized for illuminating the inside of the cabinet when the door is open and the switch closed, and so that the light is de-energized when the door is closed and the switch is open.

* * * * *